US006182616B1

(12) United States Patent
Itoh et al.

(10) Patent No.: US 6,182,616 B1
(45) Date of Patent: Feb. 6, 2001

(54) COOLING WATER CIRCULATING STRUCTURE FOR ENGINES

(75) Inventors: Jun Itoh; Haruyo Kimura, both of Fujisawa (JP)

(73) Assignee: Isuzu Motors Limited, Tokyo (JP)

( * ) Notice: Under 35 U.S.C. 154(b), the term of this patent shall be extended for 0 days.

(21) Appl. No.: 09/216,704

(22) Filed: Dec. 21, 1998

(30) Foreign Application Priority Data

Dec. 24, 1997 (JP) ..... 9-355283
Dec. 24, 1997 (JP) ..... 9-355302

(51) Int. Cl.[7] ..... F01P 7/14
(52) U.S. Cl. ..... 123/41.1
(58) Field of Search ..... 123/41.1; 236/34.5

(56) References Cited

U.S. PATENT DOCUMENTS 4,545,333 * 10/1985 Nagumo et al. ..... 123/41.1
4,580,531 * 4/1986 N'Guyen ..... 123/41.1
4,726,325 * 2/1988 Itakura ..... 123/41.1
5,275,231 * 1/1994 Kuze ..... 123/41.1
5,749,330 * 5/1998 Inque et al. ..... 123/41.1

* cited by examiner

*Primary Examiner*—John Kwon
(74) *Attorney, Agent, or Firm*—Staas & Halsey LLP

(57) ABSTRACT

A cooling water circulating structure for engines is formed by providing therein a thermostat housing 10 which holds therein a thermostat 9 which opens and closes a passage R for a radiator 5 in accordance with a cooling water temperature, and the thermostat housing further has three flanges F1, F2, F3, i.e. a first flange F1 to be joined to an engine body, a second flange F2 to which an oil filter is fixed, and a third flange F3 to which an oil cooler 7 is fixed. The three flanges F1, F2, F3 are arranged so that the surfaces thereof are on mutually different planes, whereby it is rendered possible to reduce the number of passages and pipes for the cooling water and miniaturize an engine.

9 Claims, 9 Drawing Sheets

B bypass passage
H passage for a heater core
R passage for a radiator
T passage for a cooling water pump
O oil passage B bypass passage
H passage for a heater core
R passage for a radiator
T passage for a cooling water pump
O oil passage

COOLING WATER CIRCULATING STRUCTURE FOR ENGINES

BACKGROUND OF THE INVENTION

Field of the Invention

This invention relates to an improvement in a cooling water circulating structure capable of improving the cooling performance of an oil cooler, reducing the number of pipes around an engine body, simplifying the arrangement of parts around an engine and miniaturizing the engine by improving a circulating path for engine cooling water.

The miniaturization and the reduction of weight of an engine for automobiles are progressing, and it has strongly been demanded that not only an engine body but also pipes provided outside the engine body be simplified and omitted to as great an extent as possible with a view to saving the space and lightening the engine. As a part of the measures for dealing with these problems, the improving of the cooling water circulating passages accounting for almost all the pipes provided outside the engine is also being promoted.

The cooling water circulating structure for engines will now be described. The cooling water discharged from a cooling water pump is supplied to a cylinder block and a cylinder head and cools an engine body. This cooling water is then circulated to a suction port of the cooling water pump via, for example, four paths, which will be described later, i.e. (a) a passage for a radiator, (b) a passage for a heater core, (c) a passage for an oil cooler, and (d) a bypass passage.

The (a) passage for the radiator is a passage extending from the cylinder head to a thermostat via the radiator, the (b) passage for the heater core a passage extending from the cylinder head to return to the cooling water pump via the room heating heater core. The (c) passage for the oil cooler is a passage extending from the cooling water pump to return to the same via the oil cooler, and the (d) bypass passage a passage extending from the cylinder head and shunting these units to directly reach the thermostat.

The (a) passage for the radiator, which passes the radiator, is provided to prevent the engine from being overheated, by cooling the cooling water which has cooled the cylinder block and cylinder head of the engine, and which has been increased in temperature due to the heat exchange.

The (b) bypass passage shunting the radiator is provided to prevent the cooling water from being over-cooled, since the excessive cooling of the cooling water at the time of starting the engine and at a cold time causes not only the deterioration of an engine output and fuel efficiency of the engine but also bad influence upon the engine, such as low-temperature abrasion of cylinders.

In order for the temperature of the cooling water to stay within a proper temperature range, the switching of the (a) passage for the radiator and (d) bypass passage is controlled. This switching control operation is carried out by opening either one of these passages by utilizing the expansion and contraction of a wax-packed temperature sensing member, which occur due to the temperature of the cooling water flowing in the temperature sensing member, in for example, a two-valve type thermostat wherein the passage for the radiator is joined to one inlet thereof with the bypass shunting the radiator joined to the other inlet thereof.

Namely, when the temperature of the cooling water becomes high, the (a) passage for the radiator is opened, and the (d) bypass passage shunting the radiator is closed.

Conversely, when the temperature of the cooling water becomes low, the (a) passage for the radiator is closed, and the (d) bypass passage shunting the radiator is opened.

The cooling water circulating structure is also provided with the (b) passage for the heater core for the purpose of circulating the cooling water, which has cooled the engine body, and which has thereby been heated, to the heater core which is used to heat the room.

The (c) passage for the oil cooler, which is adapted to supply cooling water to the oil cooler, is provided so as to cool a lubricating oil for the engine.

In a relative art cooling water circulating structure, the four-system cooling circulating passage comprising the (a) passage for the radiator, (b) passage for the heater core, (c) passage for the oil cooler, and (d) bypass passage and a lubricating oil circulating passage are required. Since the pipes forming these passages are arranged in a mixed state around the engine body as they are kept away from projections of devices, a large number of pipes, a large piping space and a large space for carrying out piping work become necessary, so that the miniaturization of the engine is hampered.

Since a large number of pipes are arranged in a complicated manner in a small space, they obstruct a movement of a tool during the fixing of devices, the removing thereof and the inspecting thereof. This causes an assembling operation to become troublesome, and also the work efficiency in the inspection and maintenance work to lower.

In view of these problems, one of the applicants of the present invention proposed a structure of a thermostat housing for internal combustion engines by Japanese Patent Laid-Open No. 13935/1997. This thermostat housing has a structure in which an oil cooler and an oil filter are fixed so that they are unitary with each other with some of the external pipes replaced with pipes in the thermostat housing. This enables a piping space to be saved, and the efficiency in the part fixing and maintenance work to be improved.

Concretely speaking, a cooling water circulating structure using the thermostat housing of this construction is provided with an oil cooler 7' under the thermostat housing 10', and an oil filter 8' of a laminated construction under the oil cooler 7' as schematically shown in the construction diagram of a circulating system of FIG. 11 and the explanatory perspective view of FIG. 12, so that the oil filter 8' projects downward.

This causes the space occupied by parts around the engine to increase. Consequently, in a certain type of engine, the oil filter interferes with auxiliary devices, and the space occupied by parts around the engine becomes excessively large, so that it becomes difficult to provide the oil filter in an engine room.

Moreover, when the oil cooler 7' only in this apparatus is inspected or replaced, the oil filter 8' fixed to the lower side thereof has also to be removed at the same time. Therefore, the work efficiency lowers.

In a relative art cooling water circulating structure shown in FIGS. 11 and 12, a passage H for a heater core which passes the heater core 6 and a passage C for an oil cooler which passes the oil cooler 7' are independent of each other, and these two passages meet each other in the interior of a thermostat housing 10' to extend toward the downstream side of a thermostat 9.

Accordingly, a passage between a cooling water pump 11 and cooler 7, and a pipe between the oil cooler 7' and thermostat 9 become necessary, i.e., a large number of pipes are still required.

Moreover, the detection of the temperature of the cooling water, which is necessary for the controlling of the switching of a passage R for a radiator and a bypass passage B, is carried out by a temperature sensing member 9*a* of the two-valve type thermostat 9 as shown in FIG. 11. This temperature sensing member 9*a* is provided in a portion in which one inlet port to which the passage R for the radiator is joined and the other inlet port to which the bypass passage B is joined communicate with each other, and this portion faces a discharge port.

Either one of the passage R for the radiator and bypass passage B is opened depending upon the temperature of the cooling water around the temperature sensing member 9*a*, and the cooling water is supplied from the discharge port to a cooling pump 11. A flow rate of the cooling water from the radiator is controlled in accordance with the use of these passages, whereby the temperature of the cooling water is regulated so that it stays in a predetermined range.

According to this control method, when the thermostat 9 opens the passage R for the radiator, the cooling water which has passed through the radiator 5 and decreased in temperature flows onto the temperature sensing member 9*a*, so that the temperature sensing member 9*a* is rapidly cooled with this low-temperature cooling water. Therefore, in the case where a wax type thermostat 9 is used, the wax in the temperature sensing member 9 contracts, and, consequently, the bypass passage B is selected and opened.

At the very moment the bypass passage B is opened, the high-temperature cooling water which is not cooled, and which returns directly from a cylinder head 2, flows onto the temperature sensing member 9*a*. Consequently, the temperature sensing member 9*a* is heated rapidly and expands to cause the passage R for the radiator to be opened again. These actions are necessarily repeated in a complicated manner, so that hunting occurs. The hunting occurs because the passages are controlled by the high-temperature cooling water and low-temperature cooling water a difference in temperature of which is large.

An ecofilter a demand for the use of which has increased greatly in recent years uses a container as it is so that a filter element 8' only can be replaced. When this ecofilter is used, it is necessary that a case for a cartridge be divided into two for the replacement of the filter element 8*a'*. Therefore, the number of portions to be joined together and that of parts increase correspondingly, so that the efficiency in assembling and inspection operations lowers.

SUMMARY OF THE INVENTION

The present invention has been developed with a view to solving these problems, and a first object thereof is to provide a cooling water circulating structure capable of attaining a short-sized more compact, i.e., miniaturized engine having a smaller number of external pipes by improving the circulating passage for the cooling water and thermostat housing and thereby reducing the number of the passage and pipes for the cooling water.

A second object of the present invention is to provide a cooling water circulating structure for engines, capable of making an engine as a whole compact and improving the work efficiency of inspection and replacement work by fixing an oil filter and an oil cooler to a thermostat housing without disposing them in a piled state and thereby reducing the amount of downward projection of the oil filter.

A third object of the present invention is to provide a cooling water circulating structure, capable of employing an ecofilter which enables a filter element only to be replaced, without causing the number of parts and portions to be joined together to increase.

A fourth object of the present invention is to provide a cooling water circulating structure for engines, capable of reducing the number of pipes by omitting a passage for an independent oil cooler, and thereby reducing the number of external pipes around an engine body.

A fifth object of the present invention is to provide a cooling water circulating structure for engines, capable of miniaturizing an oil cooler by decreasing the temperature of the cooling water entering the oil cooler and thereby improving the cooling performance of the oil cooler.

A further object of the present invention is to provide a cooling water circulating structure for engines, capable of preventing the occurrence of hunting during an operation for controlling of the opening of the passages for the cooling water.

The cooling water circulating structure for engines which achieves these objects is provided with a thermostat housing in which a thermostat for opening and closing a passage for a radiator in accordance with the temperature of the cooling water is provided, the thermostat housing having three flanges, i.e. a first flange to be joined to an engine body, a second flange to which an oil filter is fixed, and a third flange to which an oil cooler is fixed, the surfaces of these three flanges (F1, F2, F3) being formed and arranged in different planes.

In another embodiment, the second and third flanges are arranged in the same plane which is different from the plane in which the first flange extends.

The word "flange" used in this specification generally represents a part for joining a fluid passage between members to another fluid passage, and includes a joint portion between pipes forming fluid passages and a fluid passage-carrying flat joint portion besides a so-called outside collar type flange in a narrow sense which extends outward from a fluid passage.

According to this structure, the first to third flanges are formed so that they are arranged in mutually different planes, or so that the second and third flanges are arranged in the same plane which is different from the plane in which the first flange is disposed. Therefore, the oil filter and oil cooler are fixed to the thermostat housing without disposing the two devices in a piled state. Accordingly, a long piled portion is substantially gone, and the amount of the downwardly projecting portion of the oil filter can be reduced. Owing to such an arrangement of the oil filter and oil cooler, the cooling water passages and oil passages can be arranged efficiently on each surface defining the thermostat housing. This enables the engine as a whole to be formed compactly.

Since the oil filter and oil cooler can be fixed and removed separately, the replacement and inspection work therefor can be carried out efficiently.

The thermostat housing is provided with a first oil inlet provided in the first flange and joined to the discharge port of the oil pump, a first oil outlet opened in the third flange, communicating with the first oil inlet via an inner passage and joined to a passage extending from the oil inlet of an oil cooler, a second oil inlet formed in a second flange and joined to an oil outlet of an oil filter, and a second oil outlet opened in the first flange, communicating with the second oil inlet via an inner passage and joined to an oil inlet of an engine body.

Namely, regarding oil passages, the thermostat housing is provided with a passage, which extends from the discharge port of the oil pump to the oil inlet of the oil cooler, as an inner passage formed to provide communication between the first flange and the third flange, and a passage, which extends from the oil outlet of the oil filter to the oil inlet of the engine body, as an inner passage formed to provide communication between the second flange and the first flange.

Owing to this structure, the oil cooler fixed to the third flange can be disposed in contact with the oil filter fixed to the second flange, and this enables the engine as a whole to be formed compactly.

When a case member for holding an oil element of the oil filter therein is molded with the second flange of the thermostat housing, in other words, when a part of the oil filter and second flange are molded so that they become unitary with each other, and so that the part of the oil filter is incorporated in the thermostat housing, the number of parts can be reduced. Therefore, an ecofilter the filter element only of which can be replaced can be employed without increasing the number of parts.

The cooling water circulating structure for engines is formed so as to supply the cooling water discharged from a cooling water pump for an engine to a cylinder block and a cylinder head and cool therby the same, and circulate the cooling water discharged therefrom being circulated to the cooling water pump via or bypassing round a radiator, a heater core and an oil cooler, wherein a passage for the heater core which joins the heater core and oil cooler together is provided so that low temperature cooling water which has passed through the heater core is supplied to the oil cooler.

According to this structure, the cooling water the temperature of which has decreased to a low level due to the radiation of the heat thereof from the room-heating heater core can be supplied to the oil cooler to cool the oil. Therefore, the temperature of the cooling water entering the oil cooler can be decreased to below that in the case where the oil is cooled with the cooling water which has been discharged from a conventional cooling pump and met the cooling water from each path. Therefore, the cooling performance of the oil cooler can be improved, and the oil cooler can be miniaturized owing to the improved cooling performance thereof.

Since the passage for the heater core serves also as the passage for the oil cooler, the passage for the oil cooler is held in the thermostat housing, so that the number of pipes decreases. In the relative techniques, an independent passage for an oil cooler which extends from a cooling water pump and returns thereto via the oil cooler was necessary. According to the present invention, the number of pipes can be reduced by omitting such an independent passage for the oil cooler. As a result, the number of external pipes around an engine body can be reduced.

Since the cooling water passages for the oil cooler and oil filter are formed so that they are connected together in series, it becomes easy to arrange devices and pipes by fixing the oil filter to one surface of the thermostat housing and fixing the oil cooler to another surface thereof which is different from the surface to which the oil filter is fixed. This enables the employment of a structure in which the oil cooler and oil filter are disposed in a piled state to be avoided, the amount of a downwardly projecting portion of the oil filter to be reduced, and the engine to be formed compactly accordingly.

Owing to the above-mentioned miniaturization of the oil cooler, the omission and simplification of pipes and the avoidance of the piled structure, the engine can be miniaturized. Moreover, the work efficiency can be improved by simplifying the piping work.

The thermostat housing further holds therein a thermostat having a temperature sensing member is provided to open and close a passage for a radiator, and the cooling water which has passed through the heater core and oil cooler is supplied to the temperature sensing member to control the opening and closing of the thermostat.

Namely, the cooling water which has been cooled by the heater core and then warmed by the oil cooler to have the temperature thereof changed to a level between that of the temperature of the low-temperature water in the passage for the radiator and that of the temperature of the high-temperature water in the bypass passage shunting the radiator is introduced from a central inlet passage opened in a side wall between two valves, and not from the two inlet ports (in a valve disc) of the two-valve type thermostat, directly onto the temperature sensing member.

According to this arrangement, the cooling water which has passed through the heater core and oil cooler, and which varies in temperature gradually with the variation of the temperature of the engine, is introduced to the temperature sensing member to control the opening and closing of the passage in the thermostat.

Therefore, the opening and closing of the thermostat can be controlled by the cooling water having a comparatively small temperature variation, permitting the temperature of the engine to be easily detected and having been discharged from the oil cooler. Accordingly, the temperature sensing member is not exposed to rapid temperature variation, and the occurrence of hunting at the time of selection of the passage by the thermostat can be prevented.

DESCRIPTION OF THE PREFERRED EMBODIMENT

An embodiment of the cooling water circulating structure for engines according to the present invention will now be described with reference to the drawings. These drawings show an embodiment, and the present invention is limited by the claims thereof only, and not by the embodiment.

Figure 1:
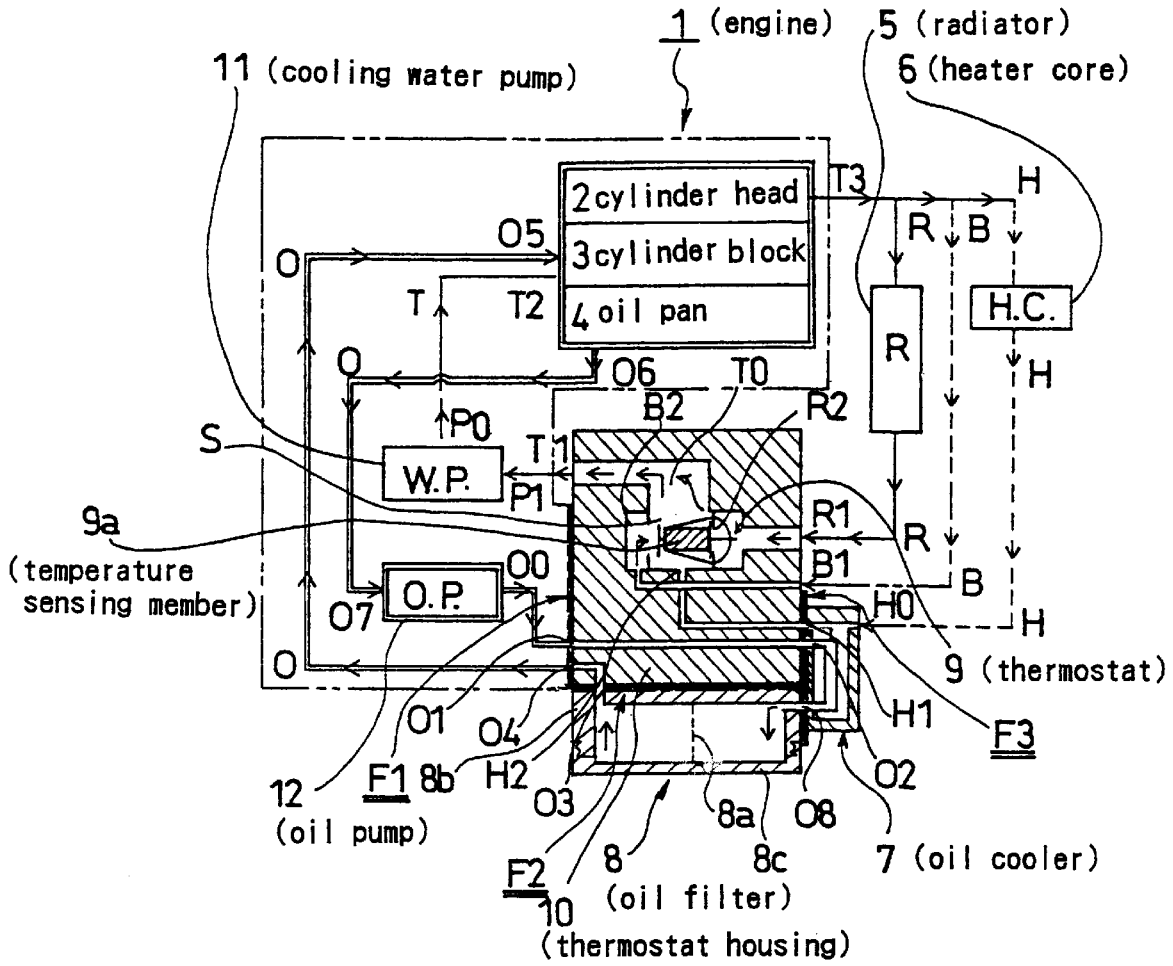
FIG. 1 is a construction diagram of a cooling water and oil circulating system for a mode of embodiment of a cooling water circulating structure for engines according to the present invention.
Figure 2:
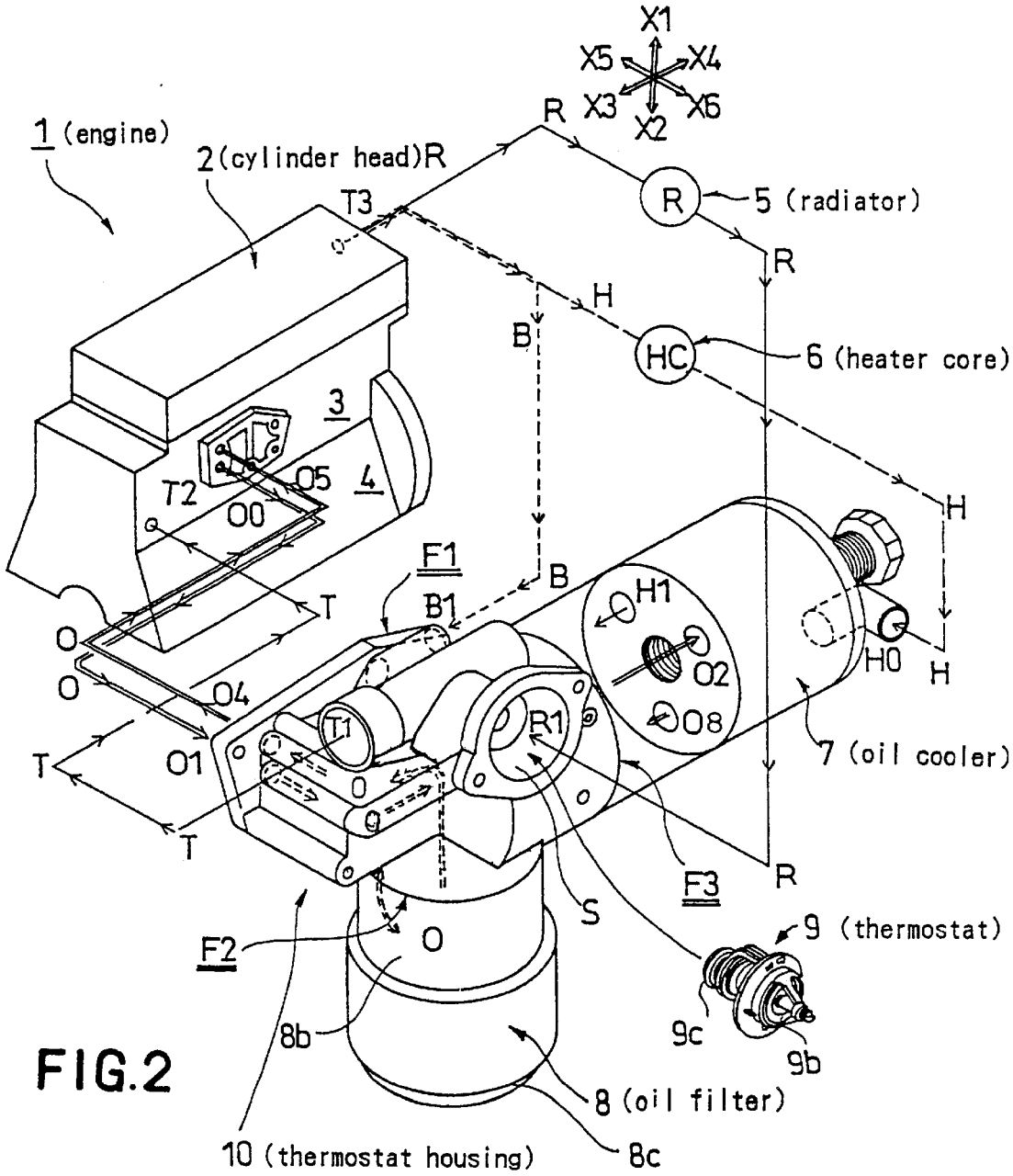
FIG. 2 is an explanatory perspective view of a mode of embodiment of the cooling water circulating structure for engines according to the present invention.
Figure 3:
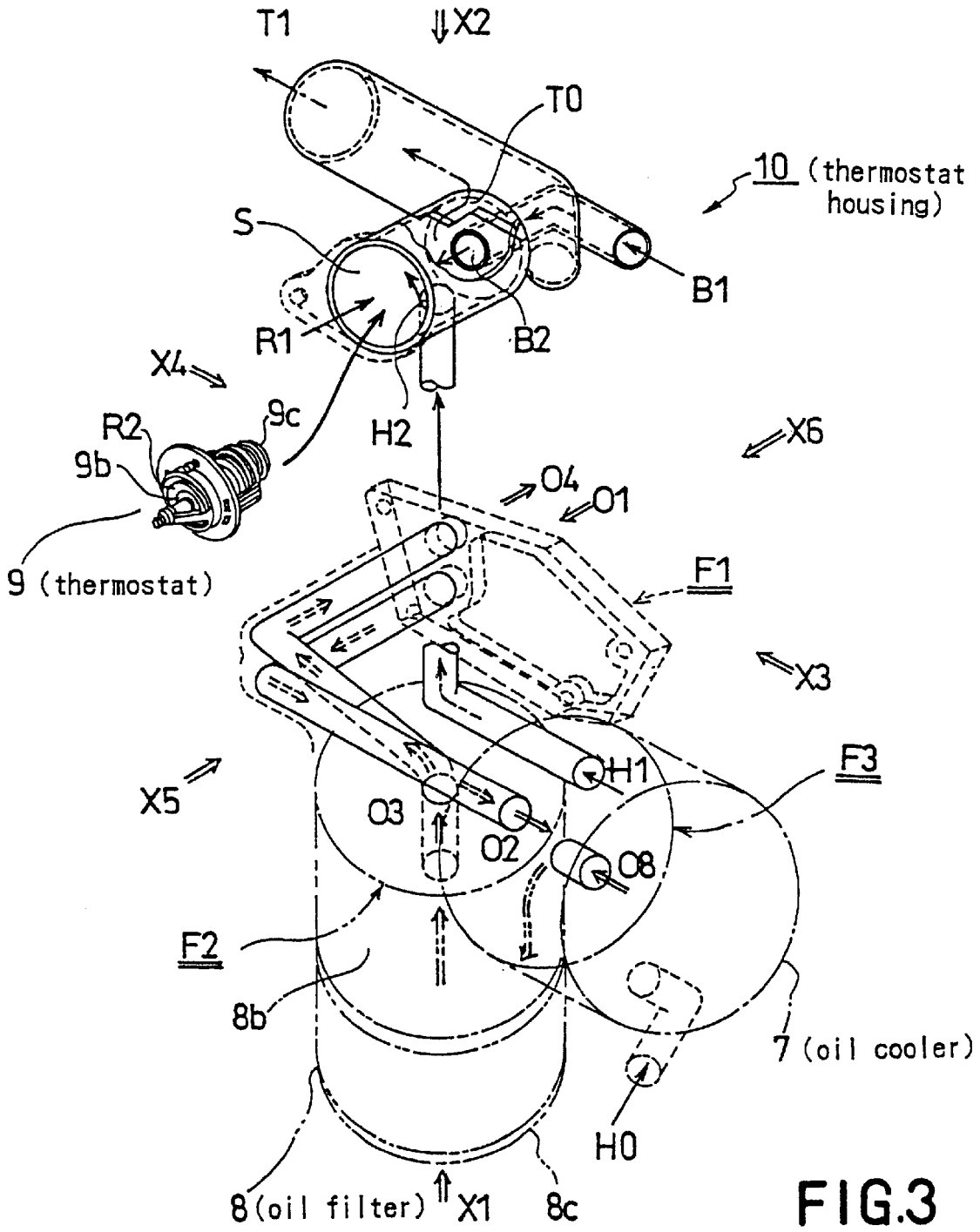
FIG. 3 is an explanatory perspective view of a cooling water passage and an oil passage in a thermostat housing provided in a mode of embodiment of the cooling water circulating structure for engines according to the present invention.
Figure 4:
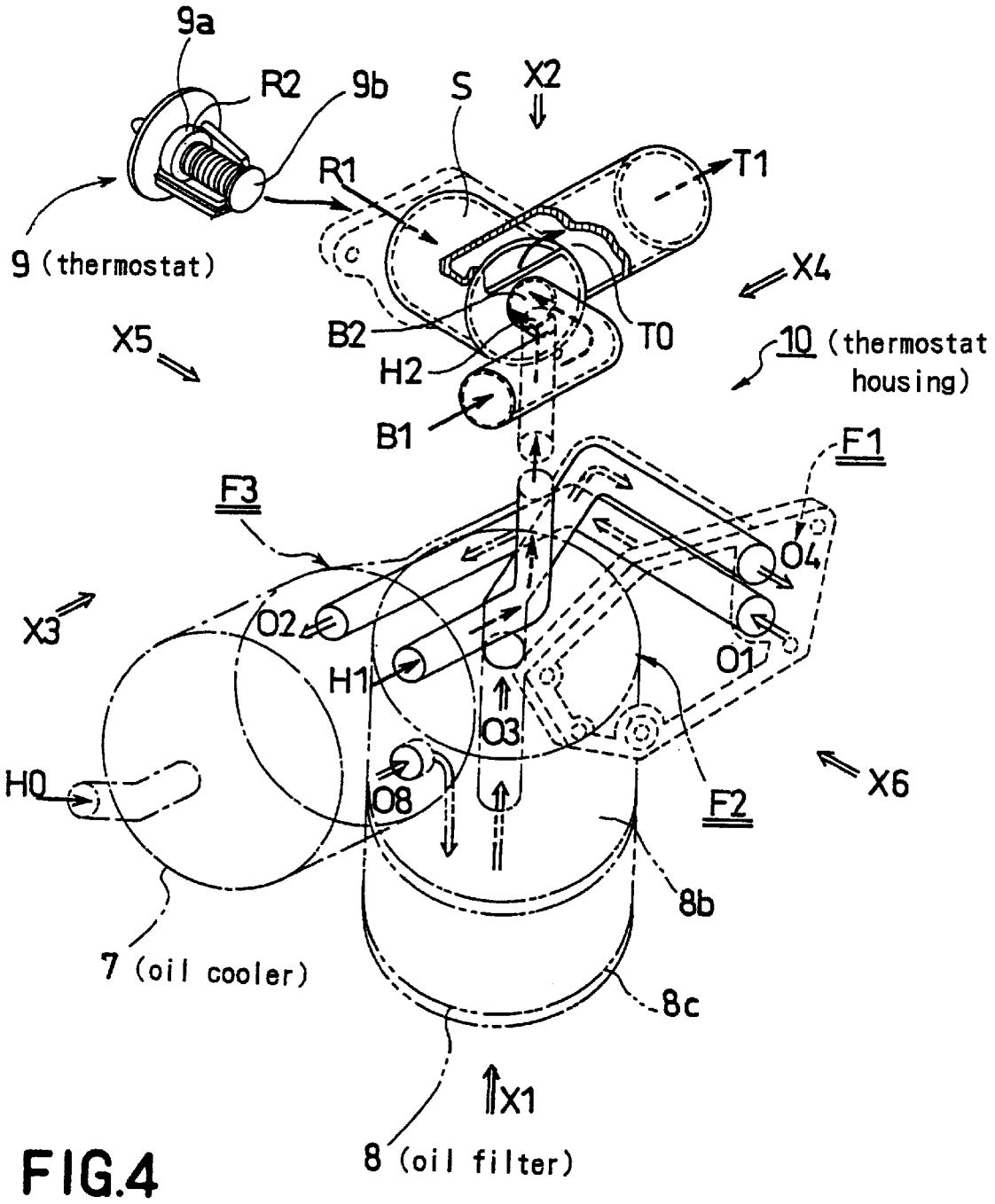
FIG. 4 is an explanatory perspective view of the cooling water passage and oil passage in the thermostat housing of FIG. 3 taken in a different direction.
Figure 5:
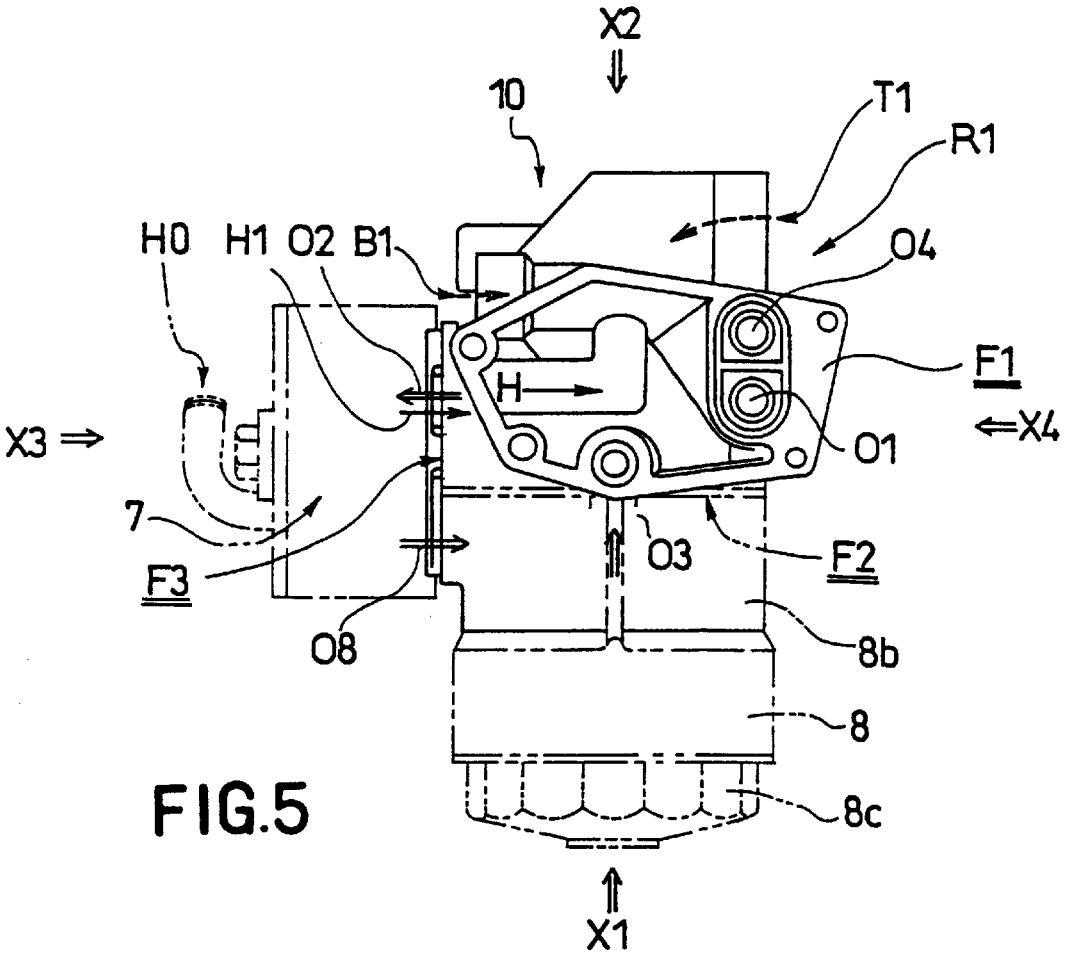
FIG. 5 is a front view showing a first flange of a thermostat housing provided in a mode of embodiment of the cooling water circulating structure for engines according to the present invention.
Figure 6:
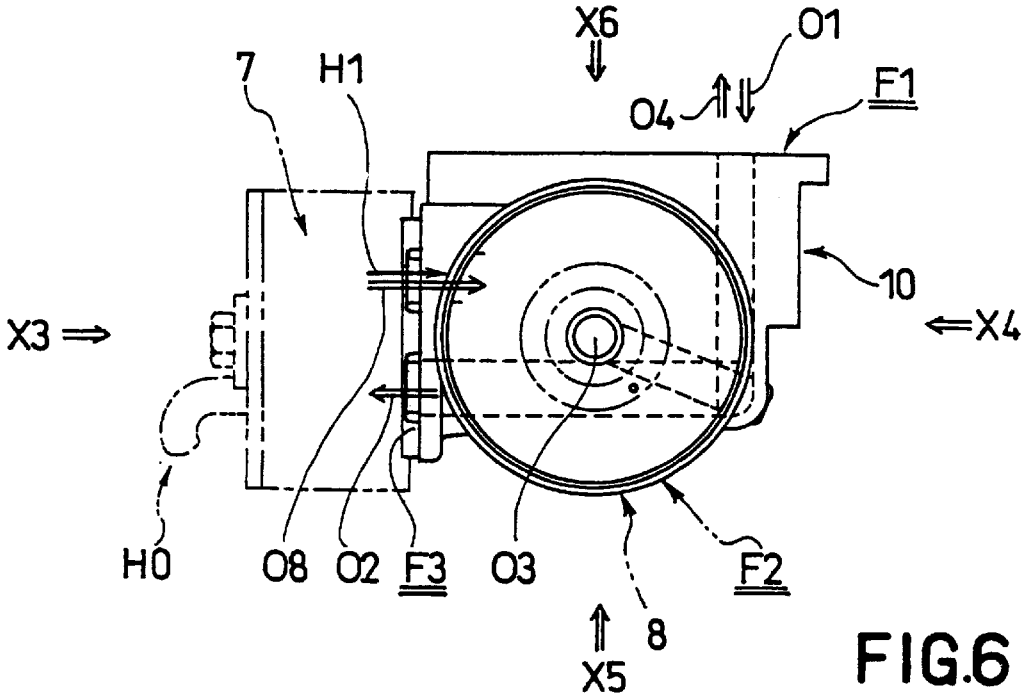
FIG. 6 is a left side view showing a third flange shown in FIG. 5.
Figure 7:
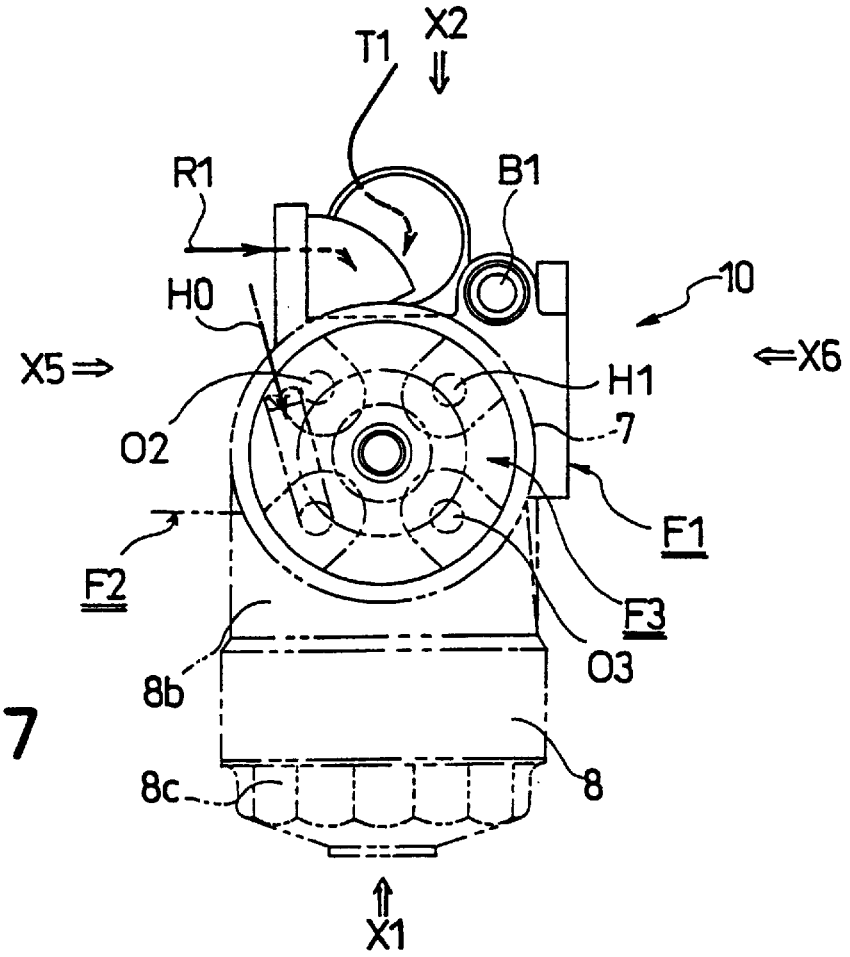
FIG. 7 is a bottom view showing a second flange shown in FIG. 5.
Figure 8:
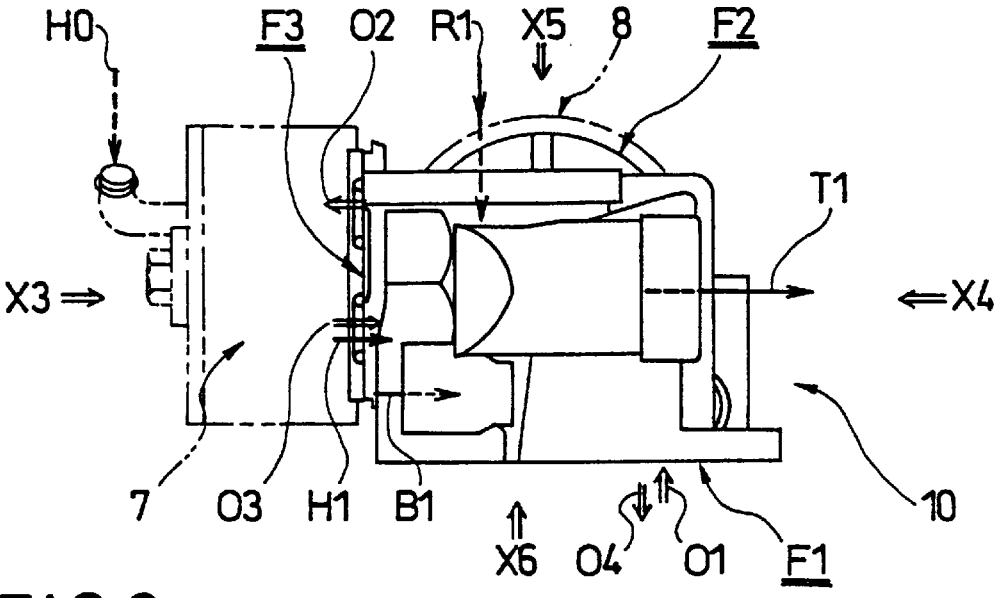
FIG. 8 is a top view of what is shown in FIG. 5.
Figure 9:
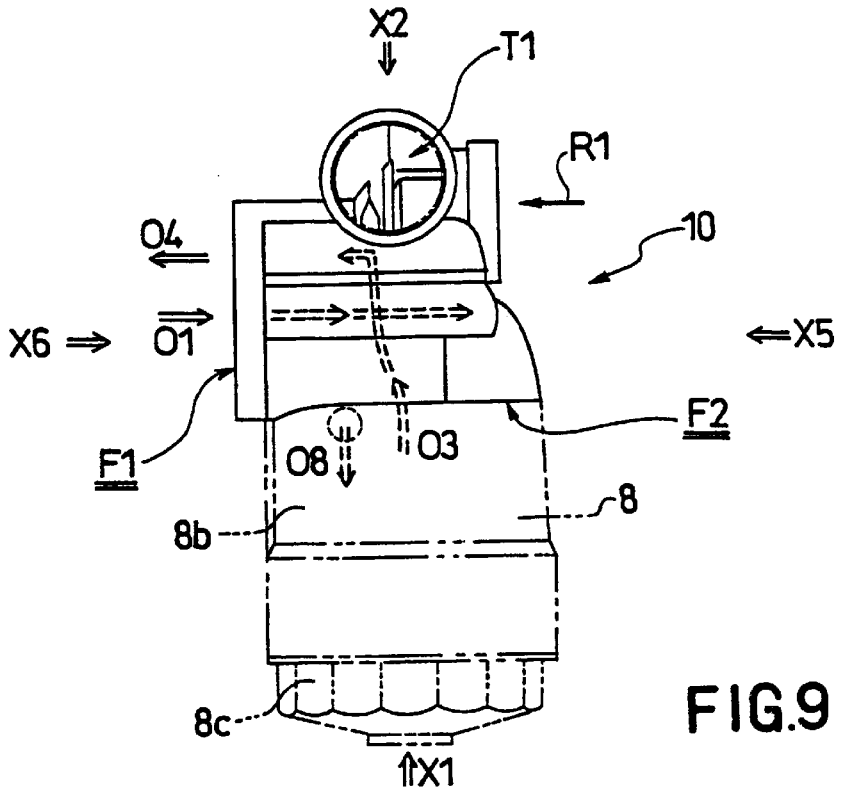
FIG. 9 is a right side view of what is shown in FIG. 5.
Figure 10:
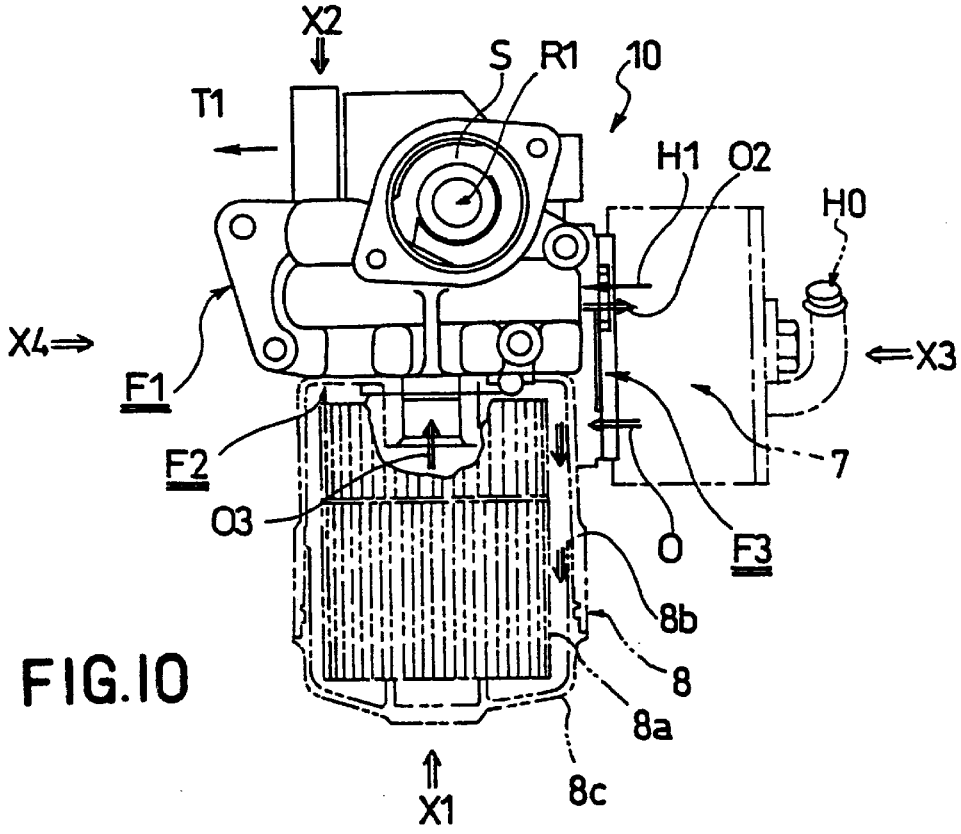
FIG. 10 is a sectioned rear view of the oil filter shown in FIG. 5.
Figure 11:
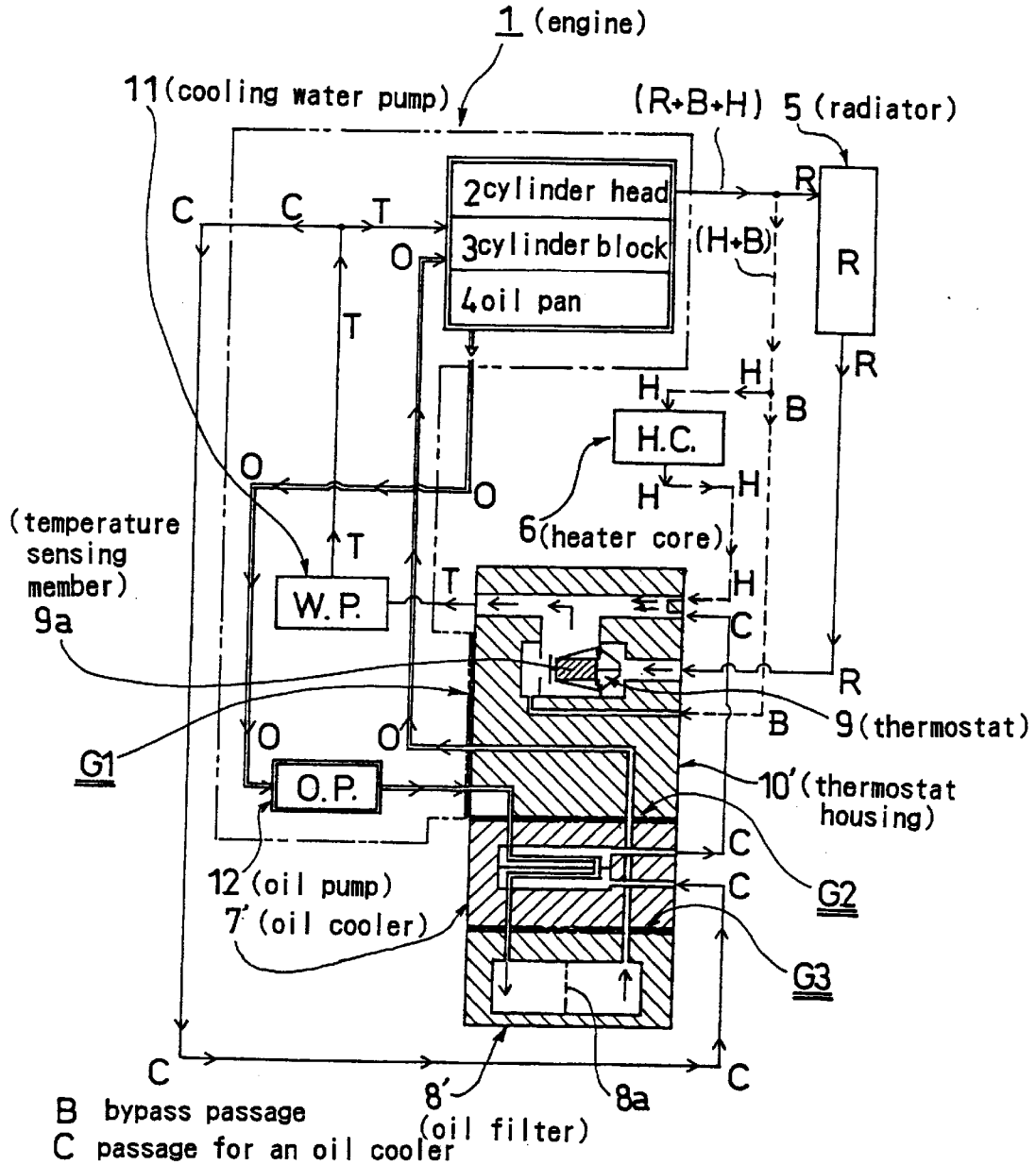
FIG. 11 is a construction diagram of a cooling water and oil circulating system for a relative art cooling water circulating structure for engines.
Figure 12:
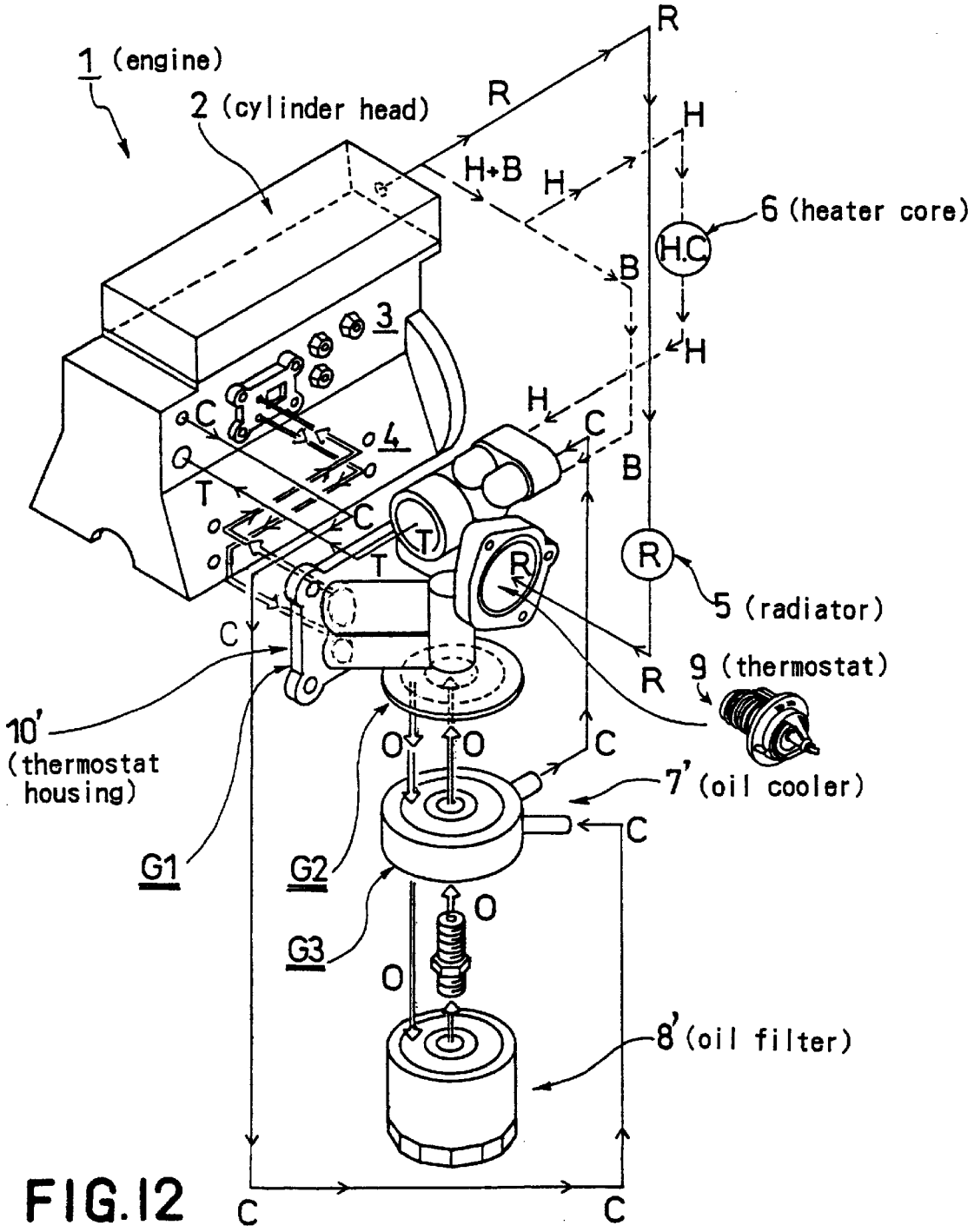
FIG. 12 is an explanatory perspective view of a relative art cooling water circulating structure for engines.

In these drawings, the construction of machining holes, blind plugs for closing these holes and minor parts is omitted. In FIGS. 3 and 4, upper and lower portions are shown in a separated state so as to have these portions seen clearly.

First, a thermostat housing used in the cooling water circulating structure for engines according to the present invention will be described.

As shown in FIGS. 1–10, this thermostat housing 10 is a housing having a thermostat chamber, a hollow portion for providing a thermostat therein, inner passages around the thermostat chamber, outlets and inlets, openings of the inner passages, and formed out of a metal material of a high thermal conductivity, such as an aluminum alloy.

A first flange F1 to be joined to an engine body 1, a second flange F2 to which an oil filter 8 for cleaning a lubricating oil is to be fixed, and a third flange F3 to which an oil cooler 7 for cooling the oil is to be fixed are provided on outer surfaces of the thermostat housing.

The arrangement of the first, second and third flanges will now be described. These three flanges F1, F2, F3 are arranged in mutually different planes. Namely, these flanges are arranged to have the positional relation in which the imaginary extensions of the surfaces of any two flanges cross each other so that they are not on the same plane.

In another embodiment, the second and third flanges F2, F3 are provided on the same plane (not shown) which is different from the plane on which the first flange F1 is provided, and the two flanges F2, F3 are arranged preferably adjacently to each other.

The inner passages for cooling water for the thermostat housing 10 are formed as described below.

First, as shown in FIGS. 1–4, the interior of the thermostat housing 10 is provided with a thermostat chamber S for holding a two-valve type thermostat 9. A first inlet port R1 and a second inlet port B1 are provided so as to be opened in the outer surfaces of the thermostat housing 10 so that external pipes can be joined thereto. An inner passage allowing communication between the first inlet port R1 and a first opening R2 of the thermostat chamber S is provided. The first opening R2 is opened and closed by a first valve disc 9*b* of the thermostat 9. An inner passage allowing communication between the second inlet port B1 and a second opening B2 of the thermostat chamber 9 is provided. This second opening B2 is opened and closed by a second valve disc 9*c* of the thermostat 9.

An outlet port T1 is provided in an outer surface of the thermostat housing 10, and this outlet port T1 and a discharge opening T0 provided in the vicinity of a side surface of a temperature sensing member 9*a* of the thermostat 9 held in the thermostat chamber S are allowed communicate with each other by an inner passage.

The outlet opening T0 at which flow passages extending from the three openings R2, B2, H2 are put together is provided, and this outlet opening T0 and outlet port T1 joined to a cooling water pump 11 are joined to each other by an inner passage.

A third inlet port H1 is provided so as to be opened in the third flange F3, and an inner passage which allows communication between this third inlet port H1 and a third opening H2 opened in the portion, in which the temperature sensing member 9*a* of the thermostat 9 is provided.

The inner passages for an oil in the thermostat housing 10 are formed as described below. As shown in FIGS. 1–4, a first oil inlet O1 provided in the first flange F1 and a first oil outlet O2 provided in the third flange F3 are joined to each other by an inner passage, and a second oil inlet O3 provided in the second flange F2 and a second oil outlet O4 provided in the first flange F1 by an inner passage.

A cooling water circulating structure and an oil circulating structure for engines which use this thermostat housing 10 will now be described.

First, an oil filter 8 is joined to the second flange F2 of the thermostat housing 10, and an oil cooler 7 to the third flange F3 thereof.

The outlet port T1 of the thermostat housing 10 and an inlet port P1 of a cooling water pump 11 are joined together, and an outlet port P0 of the cooling water pump 11 is joined to a cooling water inlet port T2 of a cylinder block 3. This cooling water inlet port T2 communicates with a cooling water outlet T3 of a cylinder head 2 via an inner cooling water passage extending through the interior of the cylinder block 3 and cylinder head 2.

The passage for the cooling water which has just been discharged from the cooling water outlet port T3 of the cylinder head 2 branches out into three systems of passages including a passage R for a radiator, a passage H for a heater core and a bypass passage B, which are joined to inlet ports R1, H0, B1 of the thermostat housing 10 and oil cooler 7.

The passage R for the radiator extends so that it is joined to a first inlet port R1 of the thermostat housing 10 via the radiator 5. The cooling water flows from this first inlet port R1 into a thermostat chamber S via an inner passage of the thermostat housing 10 and a first opening R2 in which a first valve disc member 9*b* of a two-valve type thermostat 9 having two wax-filled bottom bypass type or side bypass type valve discs is provided.

The passage H for the heater core is joined to a cooling water inlet H0 of the oil cooler 7 via the heater core 6 used to heat the interior of a vehicle. A cooling water outlet of the oil cooler 7 is joined to the third inlet port H1 of the thermostat housing 10.

The cooling water flows from the cooling water inlet port H0, passes through the inner passage of the oil cooler 7, cools the oil and then enters the third inlet port H1 of the thermostat housing 10, and it further flows from the third opening H2, which is opened in a space in the vicinity of the temperature sensing member 9*a* of the thermostat 9, into the thermostat chamber S.

The bypass passage B bypasses the radiator 5 and heater core 6, and is joined directly to the second inlet port B1 of the thermostat housing 10 via a branching point. The cooling water flows through an inner passage of the thermostat housing 10 into the thermostat chamber S via the second opening B2 in which the second valve disc member 9*c* of the thermostat 9 is provided.

The outlet port T1 which communicates with the outlet opening T0 at which the flow passages from the three openings R2, B2, H2 of the thermostat 9 are put together, and the inlet port P1 of the cooling water pump 11 are joined together as previously mentioned, whereby a cooling water circulating system is completed.

Briefly speaking, the cooling water circulating passage is formed so that the cooling water flows out from the cooling water pump 11, cools the cylinder block 3 and cylinder head 2, branches into three passage systems R, H, B, further flows from the respective inlet ports R1, H1, B1 into the thermostat housing 10 via the radiator 5 in the passage R therefor or via the heater core 6 and oil cooler 7 in the passage H for the heater core or directly through the bypass passage B, meets one another via the thermostat 9, and returns to the cooling water pump 11.

The construction of a circulating passage for the lubricating oil for an engine will now be described.

The circulating passage for the lubricating oil for an engine is formed as follows. First, a discharge port O0 of an oil pump 12 and a first oil inlet O1 of the thermostat housing 10 are joined to each other. In the third flange F3, a second oil outlet O2 communicating with the oil inlet O1 via an inner passage of the thermostat 9 is joined to an oil inlet O2 of the oil cooler 7, and an oil outlet O8 of the oil cooler 7 to an oil inlet of the oil filter 8.

The outlet of the oil filter 8 is joined to a second oil inlet O3 of the thermostat housing 10, and a second oil outlet O4 which communicates with the second oil inlet O3 via an inner passage to an oil inlet O5 of the cylinder block 3. An oil outlet O6 communicating with the oil inlet O5 via an inner passages of the cylinder block 3 and oil pan 4 is joined to an inlet port O7 of the oil pump 12. The circulating passage for the lubricating oil for the engine is completed by this arrangement.

The lubricating oil flowing in accordance with the arrangement of the circulating passage is pressurized in the oil pump 12 and enters the oil cooler 7 via the passage in the thermostat housing 10, and the oil is cooled in the oil cooler 7 with the cooling water which has passed through the passage H for the heater core. The lubricating oil then enters a case member of the oil filter 8, where the lubricating oil is filtered by a filter element 8*a*. The lubricating oil then enters the cylinder block 3, and lubricates and cools each part of the engine, the lubricating oil being thereafter returned to the oil pan 4. The lubricating oil is sucked from this oil pan 4 into the oil pump 12 and circulated.

A water cooled laminate type or tube type conventional oil cooler can be used as the oil cooler 7 for the cooling water circulating structure for engines according to the present invention. The oil filter 8 in use can comprise an oil filter formed by folding filter paper to a cylindrical shape, or an ecofilter type oil filter wherein a filter element 8*a* alone can be replaced by removing a cover 8*c* with a case member 8*b* left as it is.

According to the above-described cooing water circulating structure for engines, the following effects can be obtained.

A first effect resides in that the cooling water passages and oil passages can be arranged with a high efficiency. Especially, a piled structure of the oil cooler 7 and oil filter 8 can be avoided, so that the engine can be made compact.

In this cooling water circulating structure, the planes of the imaginary extensions of the surfaces of any two flanges among the first to third flanges F1–F3 extend so as to cross each other. Consequently, the oil filter 8 and oil cooler 7 can be arranged compactly around the thermostat housing 10.

And the same effect resides in another cooling water circulating structure, in which the second and third flanges F2,f3 are disposed on the same plane which is different from that on which the first flange F1 is disposed.

Concretely speaking, the oil cooler 7 can be Joined to the thermostat housing 10 via the F3 at a side portion of the oil filter 8, so that a piled structure of the oil filter 8 and oil cooler 7 can be avoided.

This enables the downward projection of the oil filter 8 to be prevented, and the engine to be made compact. Since the oil filter 8 and oil cooler 7 can be inspected and replaced separately, the replacement and inspection work can be carried out efficiently.

A second effect resides in the capability of the structure of reducing the number of pipes and the length thereof concerning the oil passages O which is ascribed to the provision in the thermostat housing 10 of the inner passage providing communication between the first and third flanges F1, F3, and the inner passage providing communication between the second and first flanges F2, F1.

Accordingly, the devices and pipes for cooling water and oil involved in the cooling water circulating structure can be provided in a small space, so that the engine as a whole can be formed compactly.

A third effect resides in that an ecofilter in which the filter element 8*a* only can be replaced can be employed without increasing the number of parts.

When the case member 8*b* in which the filter element 8*a* of the ecofilter type oil filter 8 is provided is molded so that it becomes unitary with the second flange F2 of the thermostat housing 10, an independent part as the case member 8*b* can be omitted. This enables the filter element 8*a* to be replaced by merely removing the cover 8*c*.

Namely, since an independent part of the case 8*b* and its fixing joint portion can be omitted, the ecofilter can be used without increasing the number of parts.

A fourth effect resides in that the oil cooling performance can be improved, so that it is possible to lessen the cooling load on the oil cooler 7, this enabling the oil cooler 7 to be miniaturized.

To be more precise, the oil in the oil cooler 7 can be cooled with the cooling water which has been subjected to heat exchange in the heater core 6 and become low in temperature, so that the cooling performance of the oil cooler 7 can be improved. Since the oil and cooling water pass through adjacent passages in the thermostat housing 10 formed out of an aluminum alloy of a high thermal conductivity, the oil can be cooled efficiently with the cooling water.

A fifth effect resides in that the occurrence of hunting in a control operation for the switching between the passage R for the radiator and bypass passage B shunting the radiator can be prevented.

Namely, owing to the cooling water circulating structure for engines according to the present invention using the thermostat housing 10, the cooling water having comparatively small variation in temperature, capable of easily detecting the temperature of the engine and having passed through the oil cooler 7 can be introduced from the third opening H2 onto the temperature sensing member 9*a* of the thermostat 9. Therefore, the temperature sensing member 9*a* is not directly exposed to the low-temperature cooling water flowing via the radiator 5 and the high-temperature cooling water flowing via the bypass passage B. As a result, the temperature variation of the cooling water contacting the temperature sensing member 9*a* is lessened, so that the occurrence of hunting at the time of switching the passage of the thermostat 9 is prevented.

What is claimed is:

1. A cooling water circulating structure for engines having a radiator, an engine body, an oil filter and an oil cooler, comprising:

a thermostat housing having first, second and third flanges, the first flange to be joined to the engine body, the second flange for fixing the oil filter thereto and the third flange for fixing the oil cooler thereto, the first through third flanges having surfaces respectively disposed in three mutually different planes; and a thermostat provided in the thermostat housing to open and close a passage for the radiator in accordance with a cooling water temperature.

2. A cooling water circulating structure according to claim 1, wherein said thermostat housing comprises:

a first oil inlet formed in the first flange and being in fluid communication with an oil pump;

a first oil outlet formed in the third flange and being in fluid communication with an inlet of an oil cooler;

a first inner passage guiding oil from the first oil inlet to the first oil outlet;

a second oil inlet formed in the second flange and being in fluid communication with an outlet of the oil filter;

a second oil outlet formed in the first flange and being in fluid communication with an oil inlet for the engine; and a second inner passage guiding oil from the second oil inlet to the second oil outlet.

3. A cooling water circulating structure according to claim 1, wherein the oil filter includes a case member and an oil filter element retained within the case member, and the case member of the oil filter is molded to the second flange of the thermostat housing.

4. A cooling water circulating structure for engines having a radiator, an engine body, an oil filter and an oil cooler, comprising:

a thermostat housing having first, second and third flanges, the first flange to be joined to the engine body, the second flange for fixing the oil filter thereto and the third flange for fixing the oil cooler thereto, the second and third flanges being disposed in the same plane, the first flange being disposed in a plane different from that of the second and third flanges; and a thermostat provided in the thermostat housing to open and close a passage for the radiator in accordance with a cooling water temperature.

5. A cooling water circulating structure according to claim 4, wherein said thermostat housing comprises:

a first oil inlet formed in the first flange and being in fluid communication with an oil pump;

a first oil outlet formed in the third flange and being in fluid communication with an inlet of an oil cooler;

a first inner passage guiding oil from the first oil inlet to the first oil outlet;

a second oil inlet formed in the second flange and being in fluid communication with an outlet of the oil filter;

a second oil outlet formed in the first flange and being in fluid communication with an oil inlet for the engine; and a second inner passage guiding oil from the second oil inlet to the second oil outlet.

6. A cooling water circulating structure according to claim 5, wherein the oil filter includes a case member and an oil filter element retained within the case member, and the case member of the oil filter is molded to the second flange of the thermostat housing.

7. A cooling water circulating structure for engines having a cylinder head and a cylinder block, comprising:

a cooling water pump to pump water to the cylinder head and cylinder block of the engine to thereby cool same;

return passages to direct water from the cylinder head and cylinder block of the engine to the cooling water pump, comprising:

heater passages to conduct water from the engine to the heater core, from the heater core to the oil cooler and from the oil cooler to the cooling water pump; and a bypass passage to direct water from the engine to the cooling water pump, while bypassing a radiator, the heater core and the oil cooler.

8. A cooling water circulating structure according to claim 7, wherein the return passages further comprise a radiator passage to direct water from the engine to the radiator and from the radiator to the cooling water pump.

9. A cooling water circulating structure according to claim 8, further comprising a thermostat having a temperature sensor, the thermostat opening and closing the radiator passage based on the temperature sensed by the temperature sensor, the temperature sensor receiving and sensing the temperature of cooling water which has passed through the heater core and the oil cooler.

* * * * *